US009702044B2

(12) United States Patent
Banno et al.

(10) Patent No.: US 9,702,044 B2
(45) Date of Patent: Jul. 11, 2017

(54) METHOD FOR REGENERATING PLATING LIQUID, PLATING METHOD, AND PLATING APPARATUS

(71) Applicant: Fuji Shoji Co., Ltd., Hashima-shi (JP)

(72) Inventors: Tatsuya Banno, Hashima (JP); Katsuhiro Goto, Hashima (JP); Nobuhiro Kanazawa, Hashima (JP)

(73) Assignee: FUJI SHOJI CO., LTD., Hashima-shi (JP)

( * ) Notice: Subject to any disclaimer, the term of this patent is extended or adjusted under 35 U.S.C. 154(b) by 580 days.

(21) Appl. No.: 14/349,194

(22) PCT Filed: Nov. 27, 2012

(86) PCT No.: PCT/JP2012/080639
§ 371 (c)(1),
(2) Date: Apr. 2, 2014

(87) PCT Pub. No.: WO2013/080978
PCT Pub. Date: Jun. 6, 2013

(65) Prior Publication Data

US 2015/0037512 A1 Feb. 5, 2015

(30) Foreign Application Priority Data

Nov. 30, 2011 (WO) ..... PCT/JP2011/077647

(51) Int. Cl.
*C23C 18/16* (2006.01)
*C23C 18/38* (2006.01)
(Continued)

(52) U.S. Cl.
CPC ..... *C23C 18/1617* (2013.01); *C23C 18/1632* (2013.01); *C23C 18/1633* (2013.01);
(Continued)

(58) Field of Classification Search
CPC ..... C23C 18/1617; C23C 18/54; C25D 21/16–21/22; C25C 1/12; C23D 21/18
See application file for complete search history.

(56) References Cited

U.S. PATENT DOCUMENTS

| | | | |
|---|---|---|---|
| 6,120,673 | A | 9/2000 | Reiter et al. |
| 6,235,180 | B1 | 5/2001 | Kobayashi et al. |
| 2004/0129209 | A1 | 7/2004 | Asakawa et al. |

FOREIGN PATENT DOCUMENTS

| | | | |
|---|---|---|---|
| CN | 1242439 | A | 1/2000 |
| CN | 1498290 | A | 5/2004 |

(Continued)

OTHER PUBLICATIONS

Eilenburger Elektrolyse- und Umwelttechnik GmbH, English abstract and machine translation, DE 10 2007 010 408 A1 (2007).*

(Continued)

*Primary Examiner* — James Lin
*Assistant Examiner* — Ho-Sung Chung
(74) *Attorney, Agent, or Firm* — Oblon, McClelland, Maier & Neustadt, L.L.P.

(57) ABSTRACT

A problem to be solved is to provide a method for regenerating plating liquid from plating waste liquid in a simple and easy way and a plating method utilizing the regenerating method.

A method for regenerating plating liquid from plating waste liquid that is produced as a result of performing a copper plating on steel and that contains respective ions of Fe, Cu and Sn comprises repetitively performing processing steps of applying electric current with the plating waste liquid 11 side taken as a cathode 15 and electrolytic solution 12 side taken as an anode 16 in the state that the plating waste liquid 11 and the electrolytic solution 12 are connected through an anion exchange membrane 13; separating copper by making a copper deposition electrode as a result of depositing (Continued)

copper on the cathode 15 being in contact with the plating waste liquid 11, to turn the plating waste liquid to processed remaining liquid; and using as the anode 16 a copper deposition electrode formed previously and dissolving copper in the electrolytic solution 12 to generate copper ion-containing solution.

7 Claims, 1 Drawing Sheet

(51) Int. Cl.

| | |
|---|---|
| ***C25D 21/14*** | (2006.01) |
| ***C25D 5/36*** | (2006.01) |
| ***C25D 7/06*** | (2006.01) |
| ***C25D 21/22*** | (2006.01) |
| ***C23C 18/18*** | (2006.01) |
| ***C25C 1/06*** | (2006.01) |
| ***C25C 1/12*** | (2006.01) |
| *C25D 3/38* | (2006.01) |
| *C25D 3/58* | (2006.01) |
| *C25D 17/10* | (2006.01) |

(52) U.S. Cl.
CPC ..... *C23C 18/1637* (2013.01); *C23C 18/1848* (2013.01); *C23C 18/38* (2013.01); *C25C 1/06* (2013.01); *C25C 1/12* (2013.01); *C25D 5/36* (2013.01); *C25D 7/0607* (2013.01); *C25D 21/14* (2013.01); *C25D 21/22* (2013.01); *C25D 3/38* (2013.01); *C25D 3/58* (2013.01); *C25D 17/10* (2013.01)

(56) References Cited

FOREIGN PATENT DOCUMENTS

| | | | | |
|---|---|---|---|---|
| DE | 10 2007 010 408 | A1 * | 1/2006 | ..... C25D 21/18 |
| GB | 899959 | * | 6/1962 | |
| JP | 2 290977 | | 11/1990 | |
| JP | 6 256999 | | 9/1994 | |
| JP | 7 3500 | | 1/1995 | |
| JP | 10 195699 | | 7/1998 | |
| JP | 10 317154 | | 12/1998 | |

OTHER PUBLICATIONS

Eilenburger Elektrolyse- und Umwelttechnik GmbH, Human Translation, DE 10 2007 010 408 A1 (2007).*

International Search Report Issued Mar. 5, 2013 in PCT/JP12/080639 Filed Nov. 27, 2012.

Combined Chinese Office Action issued May 19, 2015 in Patent Application No. 201280054964.3 (with English translation of categories of cited documents).

* cited by examiner

METHOD FOR REGENERATING PLATING LIQUID, PLATING METHOD, AND PLATING APPARATUS

CROSS REFERENCE TO RELATED APPLICATIONS

The present application is a 35 U.S.C. §371 national stage patent application of International patent application PCT/JP2012/080639, filed on Nov. 27, 2012, published as WO/2013/080978 on Jun. 6, 2013, the text of which is incorporated by reference, and claims the benefit of the filing date of Japanese application no. PCT/JP2011/077647, filed on Nov. 30, 2011, the text of which is also incorporated by reference.

TECHNICAL FIELD

The present invention relates to a method for regenerating fresh plating liquid by utilizing plating waste liquid that is produced after performing copper plating or bronze plating on steel, and to a plating method and a plating apparatus capable of reducing the amount of the waste liquid by employing the regenerating method.

BACKGROUND ART

As one of methods for performing copper plating or bronze plating on steel, there is an immersion plating in which members to be plated are immersed in plating liquid containing copper sulfate or containing copper sulfate and stannous sulphate. This immersion plating utilizes the difference in ionization tendency between iron and copper or stannum, and iron of the amount corresponding to the amount of the plated copper or bronze dissolves in the plating waste liquid.

Because the plating waste liquid contains cations such as Cu ions, Fe ions or the like and ions such as sulfate ions or the like, the plating waste liquid is neutralized and then, metal is recovered therefrom by adding coagulating agent to coagulate the cations, whereby the paling waste liquid thus purified is drained.

Further, as a method for recovering metals from plating waste liquid, there is disclosed a method in which tinning waste liquid containing Fe ions and Sn ions is forced to pass through a strongly acidic cation exchange resin to recover the cations through absorption of the same to the exchange resin and in which then, acid is forced to pass through the exchange resin absorbing the cations to recover the cations in the acid, and Sn is then separated through precipitation (Patent Document 1).

PRIOR ART DOCUMENT

Patent Document

Patent Document 1: JP7-3500 A (refer to claims and the like)

SUMMARY OF THE INVENTION

Problem to be Solved by the Invention

However, in the method of Patent Document 1 or the like, strong acid is required for recovering the cations from the strongly acidic cation exchange resin, or the addition of chemicals from outside such as the addition of sodium hydroxide is required to precipitate the cations, so that a lot of time and effort is required for recovery and disposal of the chemicals so added. In addition, a chemical is required for neutralization.

The present invention has been made taking the foregoing circumstances into consideration, and a problem to be solved is set to providing a method for regenerating plating fluid from plating waste liquid in a simple and easy way.

Further, the present invention takes, as another problem to be solved, providing a plating method and a plating apparatus capable of reducing the amount of plating waste liquid by utilizing the aforementioned plating liquid regenerating method.

Solution to the Problem

The feature of a plating liquid regenerating method according to a first aspect for solving the foregoing problem resides in a plating liquid regenerating method for regenerating plating liquid from plating waste liquid that is produced as a result of performing a copper plating on steel and that contains Fe ions and Cu ions, the method repetitively performing the following processing steps:

applying electric current with the plating waste liquid side taken as a cathode and electrolytic solution side taken as an anode in the state that the plating waste liquid and the electrolytic solution are connected through an anion exchanger; separating copper from the plating waste liquid by making a copper deposition electrode as a result of depositing copper on the electrode being in contact with the plating waste liquid, to turn the plating waste liquid to processed remaining liquid; and using as the anode a copper deposition electrode formed previously and dissolving copper in the electrolytic solution to generate copper ion-containing solution.

In an immersion plating method for performing a plating by immersing steel in plating liquid containing copper ions, as the plating proceeds, the Cu ions in the plating liquid are consumed to decrease and Fe ions increase by an amount corresponding to the consumed Cu ions. Regarding the consumed Cu ions, it is possible to replenish Cu ions of the amount corresponding to the consumed amount in a suitable way such as a continuously constant rate pump or the like. Since an increase in Fe ion results in impeding the progress of copper plating or bronze plating, it becomes necessary to decrease the amount of Fe ions in the manner of renewing the liquid or the like so that the increase of Fe ions to a certain level does not affect the plating.

By applying electric current to the plating waste liquid containing Cu ions and Fe ions, it is possible to deposit Cu, being smaller in ionization tendency than Fe, on the cathode on a priority basis. Therefore, by controlling the amount of electric current applied, to an appropriate amount corresponding to the amount of Cu ions, it is possible to nearly terminate the deposition of Cu before the deposition of Fe. Sulfate ions contained in the plating waste liquid move into the electrolytic solution on the anode side.

By employing the electrode with copper deposited thereon as an anode at the next step, copper ions dissolve in the electrolytic solution at the anode, whereby plating liquid can be regenerated. In the case of copper ions becoming short, replenishing copper ions makes it possible to regenerate plating liquid that can be used. Accordingly, it becomes unnecessary to dispose of the waste liquid containing copper and sulfate ions.

The invention according to a second aspect resides in that in the first aspect, Sn ions are contained in the plating waste liquid. Sn ions are easier to deposit than Fe ions, and hence, it is possible to effect the deposition as a matter of course in removing Fe ions. Accordingly, it is also possible to easily perform removing Sn ions without spending man-hour so much. Plating liquid employed for bronze plating can be exemplified as plating waste liquid containing Sn ions.

The invention according to a third aspect resides in that in the first or second aspect, the invention comprises an iron removal step of depositing a substance containing iron elements by taking the processed remaining liquid as a cathode side and new electrolytic solution, connected to the processed remaining liquid through an anion exchanger, as an anode side and then by applying electric current; and that the method include using water solution on the anode side after the iron removal step as the electrolytic solution at the processing steps.

Since the removal of iron results in decreasing a substance that impedes the progress of the plating, the water solution itself after the removal of iron can be regenerated as the electrolytic solution. As a result, it is possible to reduce the amount of the waste liquid or to eliminate the same.

The invention according to a fourth aspect resides in that in the third aspect, before the iron removal step, there is provided with a pH control step of adding an oxygen-containing chemical compound comprising $H_2O_2$, $O_3$ or $H_2O$ to raise pH. In order to facilitate the deposition of iron at the iron removal step, it is desirable to make the pH to a certain level (e.g., to a level in a range from pH2 to pH3). Although it is possible to raise the pH by continuing the application of electric current at the iron removal step, electric current required to raise the pH and the time taken to apply such electric current become unnecessary if the pH can be raised by the addition of some substance. Therefore, it is desirable to choose, as the substance to be added, an oxygen-containing chemical compound comprising $H_2O_2$, $O_3$ or $H_2O$ being a substance that does not impede the plating step or that immediately dissolves to change to an innocuous substance.

The invention according to a fifth aspect resides in that in any one of the first to fourth aspects, it is possible at the processing steps to apply electric current of an amount that corresponds to a greater one of a current amount corresponding to the amount of copper ions contained in the plating waste liquid and a current amount corresponding to the amount of copper adhered to the copper deposition electrode.

By applying electric current of the amount corresponding to the amount of copper ions, it is possible to separate copper elements and iron elements to the degree at which no problem arises in practical use.

The invention according to a sixth aspect resides in that in any one of the first to fifth aspects, the invention comprises an iron removal step of depositing a substance containing iron elements by taking the processed remaining liquid as a cathode side and new electrolytic solution, connected to the processed remaining liquid through an anion exchanger, as an anode side and then by applying electric current; and that the method includes using water solution on the cathode side after the iron removal step as the electrolytic solution at the processing steps.

Since the removal of iron ions contained in the processed remaining liquid enables the same to be reutilized as electrolytic solution at the processing steps, it is possible to reduce the amount of waste liquid that is discharged outside the system because of being unable to be processed, or to eliminate the waste liquid.

A plating method according to a seventh aspect is a plating method for plating a wire made of steel with plating liquid containing Cu ions, wherein the method comprises:

a pretreatment step including an electrolytic degreasing step of performing electrolytic degreasing on the surface of the wire by immersing the wire in degreasing liquid with electric current applied, to turn the wire to a pretreated wire;

a plating step of plating the pretreated wire by immersing the wire in the plating liquid to turn the wire to a plated wire; and a finishing step including a washing step of washing the surface of the plated wire by immersing the plated wire in cleaning liquid taking water as major constituent and a drying step of drying the washed wire;

wherein the method includes:

a regenerating step of regenerating the plating liquid by the aforementioned plating liquid regenerating method while plating waste liquid produced from the plating liquid at the plating step is made to contact the cathode and waste liquid at the washing step is made to contact the anode;

adding the processed remaining liquid at the regenerating step to the degreasing liquid at the electrolytic degreasing step and adding the copper ion-containing solution to the plating liquid at the plating step;

processing the degreasing liquid at the electrolytic degreasing step by an iron removal step of removing Fe ions contained in the degreasing liquid, to reduce an Fe ion concentration; and approximately equalizing the amount of water added to the cleaning liquid at the washing step with the amount of water vaporizing at the electrolytic decreasing step.

In the plating present method, it becomes possible to make an approximate agreement in balance between the amount of water charged and the amount of water consumed. Thus, excessive plating waste liquid is not produced, and hence, the disposal of the plating waste liquid can be simplified or becomes unnecessary.

The invention according to an eighth aspect resides in that in the seventh aspect, the pretreatment step includes, before the electrolytic degreasing step, an oxide film removal step of removing oxide films on the surface of the wire;

that the removal of the oxide films can be carried out by a surface treatment device for a long wirelike article that performs a surface treatment on a long wirelike article movably passing through powder which is charged in an elastic tube to be supplied to or discharged from the tube; and that the surface treatment device includes at least one surface treatment unit, the surface treatment unit being characterized by comprising:

the tube charged with the powder which can be supplied to or discharged from the tube, and having the long wirelike article movably passing through the powder;

pressing means for cyclically pressing and releasing the tube; and feed means for moving the long wirelike article passing through the powder.

The surface treatment device is a device of dry type and is able to recover oxide existing on the surface of the wire in the form of particles. Therefore, it does not occur that waste liquid is produced also at the oxide film removal step.

A plating apparatus according to a ninth aspect is a plating apparatus that plates a wire made of steel with plating liquid containing Cu ions, and the apparatus comprises:

a pretreatment section including an electrolytic degreasing section that performs electrolytic degreasing on the surface of the wire by immersing the wire in degreasing liquid with electric current applied, to turn the wire to a pretreated wire;

a plating section that plates the pretreated wire by immersing the wire in the plating liquid to turn the wire to a plated wire; and a finishing section including a washing section that washes the plated wire by immersing the plated wire in cleaning liquid taking water as major constituent, and a drying section that dries the washed wire;

the apparatus including:

a regenerating section that regenerates the plating liquid by the aforementioned plating liquid regenerating method while plating waste liquid produced from the plating liquid in the plating section is made to contact the cathode and waste liquid in the washing section is made to contact the anode;

adding the processed remaining liquid in the regenerating section to the degreasing liquid in the electrolytic degreasing section and adding the copper ion-containing solution to the plating liquid in the plating section;

processing the degreasing liquid in the electrolytic degreasing section by an iron removal section that removes Fe ions contained in the degreasing liquid, to reduce an Fe ion concentration; and approximately equalizing the amount of water added to the cleaning liquid in the washing section with the amount of water vaporizing in the electrolytic decreasing section.

The apparatus is concretized exactly from the aforementioned plating method according to the present invention and is able to achieve the same operations and effects as those in the previously described plating method.

Effects of the Invention

By taking the aforementioned constructions, the plating waste liquid regenerating method, the plating method and the plating apparatus of the present invention make it possible to effectively recover or separate the metal ions (Cu ions and Fe ions and, as the case may be, Sn ions) contained in the plating waste liquid, and the processed remaining liquid from which the metal ions have been removed becomes easy for reutilization, so that it becomes possible to remarkably reduce the amount of the waste liquid discharged outside the system.

FORM FOR PRACTICING THE INVENTION

Figure 1:
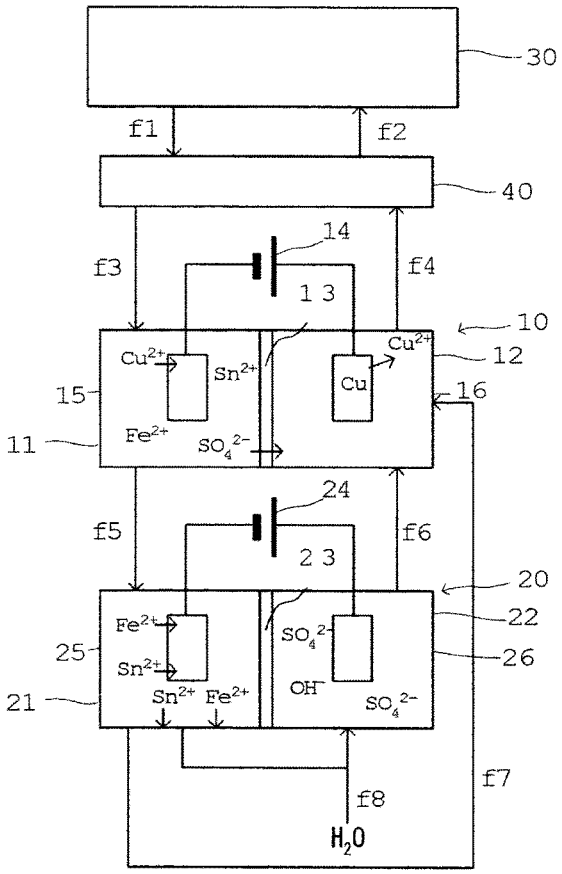
FIG. 1 is a schematic view of an apparatus that is preferably usable in a regenerating method used in the description of an embodiment.

Hereafter, based on an embodiment, description will be made in detail regarding a plating liquid regenerating method, a plating method and a plating apparatus according to the present invention. The plating liquid regenerating method in the present embodiment is a method for regenerating plating liquid that can be used again in performing plating, from plating waste liquid which is produced after copper plating (immerse plating) is performed on to-be-plated members made of a material (steel) taking iron as chief constituent. The plating liquid contains Cu ions and also contains sulfate ions as counter ions. Further, it is possible to make the plating liquid contain ions of an element like Sn (element more variable than Fe) together with Cu ions. Sn, together with Cu, is plated on the members to be plated (bronze plating). By the use of the plating liquid, a plating is performed by the plating method and the plating apparatus in the present embodiment.

(Plating Liquid Regenerating Method)

For the purpose of regenerating plating liquid from plating waste liquid, the plating liquid regenerating method in the present embodiment separates and recovers Cu ions and sulfate ions contained in the plating waste liquid and makes the Cu ions and the sulfate ions dissolved in water to regenerate the plating liquid. Fe ions and Sn ions are reduced to be recovered as iron and stannum.

The method for recovering copper and sulfate ions from the plating waste liquid is carried out by immersing an electrode (on the cathode side) in the plating waste liquid and by applying electric current. An electrode on the anode side is immersed in electrolytic solution. The electrolytic solution is made to communicate with the plating waste liquid through an anion exchanger. Thus, by electrification, the sulfate ions in the plating waste liquid move into the electrolytic solution through the anion exchanger. It is possible to supplement sulfate ions by adding sulfuric acid in the course of the electrification.

It suffices for the electrolytic solution on the anode side to contain electrolyte of the degree that enables electrification at an early stage of a regenerating step. Particularly, one containing sulfate ions is preferable as the electrolytic solution. Further, water may be used as it is. Electrification is sufficiently possible through impurities contained in water or through ions that slightly dissolve from the anion exchanger. As the anion exchange, there is exemplified anion-exchanger resin (particularly, one being membranous is preferred and further, one being thin in the thickness is more preferred) having a cationic group such as amino group.

In the liquid on the cathode side after the recovery of Cu ions is carried out by electrifying the plating waste liquid, Fe ions remain as metal ions, and Sn ions also remain where the original plating liquid contains the Sn ions. Thus, in order to recover the Fe ions and the Sn ions, the liquid on the cathode side is subjected to the next step. Specifically, there is applied a voltage of the level that enables the Fe ions and the Sn ions to deposit. Because a part of the Sn ions forms precipitations also at the preceding step of depositing the Cu ions, it is possible to separate Sn elements by fractionating the precipitations in the liquid. The electrolytic solution on the anode side is dilute sulfuric acid raised in concentration after the very first step (where no copper deposited adheres to the anode) and can be used for replenishment of water and sulfate ions into the plating liquid. Furthermore, at a step at the second time or any subsequent time (where one with copper deposited thereon is used as the anode), the electrolytic solution on the anode side has turned into the solution in which copper sulfate has dissolved through the dissolving of the copper deposited on the surface of the anode. The solution can be utilized as raw material for the plating liquid by having copper ions, stannous ions or sulfate ions replenished thereto if need be or by being diluted with water on the contrary. By the electrification at the first time, oxygen is generated from the anode.

As the electrodes, there are used those which do not dissolve and melt away in a voltage range enabling Cu ions to deposit and dissolve. For example, the electrodes can be constituted by a metal being hard to corrode such as platinum, iridium, stainless steel or the like (there may be used those having platinum, iridium or the like plated on the surface), an oxided substance having electroconductivity like iridium oxide or the like, a conductive resin, a carbon material or the like. Further, it is desirable that the surface area of the electrode (cathode) be determined in dependence on the amount of the Cu ions contained in the plating waste liquid. The cathode has Cu deposited thereon, and the Cu deposited becomes easy to come off as the Cu deposited increases in thickness. Since the operation for recovering the Cu having come off is complicated, it is desirable that the surface area of the cathode be made to be large to decrease the thickness of the Cu deposited so that the coming-off of the Cu is hard to take place. Further, in order to be ready for the coming-off of the Cu deposited, it is desirable that the electrode be surrounded by a net or has a saucer or a catching net arranged thereunder. It is desirable that the net, the saucer, the catching net or the like be electrically connected to the electrode.

The voltage applied to the electrodes is set to a magnitude enough to enable Cu ions to deposit. Further, it is desirable that the electrolysis of water be suppressed by setting the voltage to the level that does not induce the electrolysis of water. Further, setting the voltage to the magnitude at which Sn ions and Fe ions do not deposit is desirable because it can be prevented that stannum or iron is mixed with the copper deposited (namely, that stannum or iron is mixed with plating liquid to be regenerated).

The magnitude of electric current and the total amount of electric current are determined in dependence on to what degree the Cu ions are to be deposited or to what degree iron is allowed to be mixed with the copper deposited. Desirably, electric current is applied by the amount corresponding to the amount of the Cu ions. By applying electric current of the amount corresponding to the amount of the Cu ions, it is possible to stop the reaction before Sn ions and Fe ions deposit. Where the copper deposited is desirous to be high in purity, it is desirable that electric current be applied by a somewhat smaller amount than the amount corresponding to the amount of the Cu ions contained in the plating waste liquid. Further, where the recovery amount of the Cu ions is desirous to be increased, the deposit amount of copper can be increased by applying electric current of a more amount than the amount corresponding to the amount of the Cu ions existing in the waste liquid. Furthermore, a criterion for stopping the application of electric current can be judged by measuring the quantity of state regarding the phenomenon that increases or decreases in connection with the amount of the copper ions. For example, as the quantity of state, it is possible to exemplify the color of the plating waste liquid, the pH of the plating waste liquid, the time elapsed (related to the total amount of the electric current applied), the conductivity of the plating waste liquid, the value of the electric current flowing between the cathode and the anode, or the like.

Figure 2:
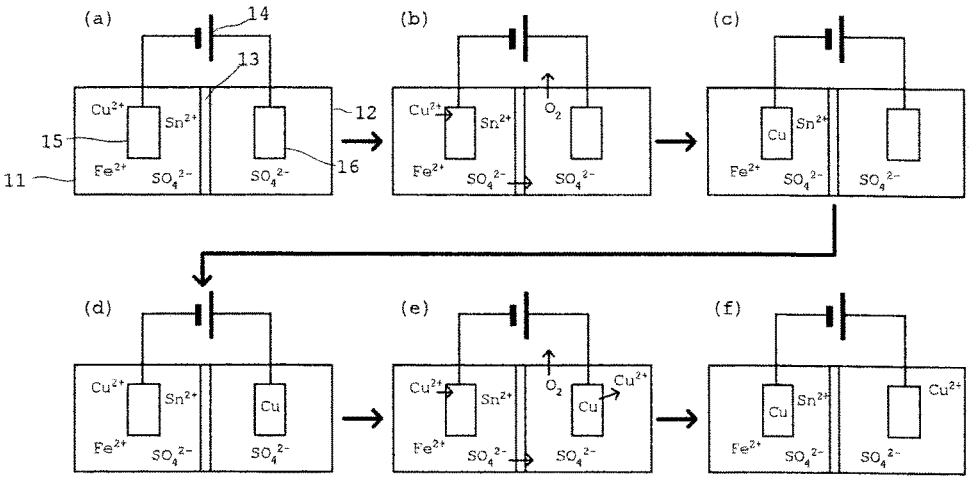
FIG. 2 is a chart tracing reactions in the method of the present invention.

Hereinafter, one example of the plating liquid regenerating method in the present embodiment will be described with reference to the drawings (FIGS. 1 and 2). The plating liquid is filled in a plating bath 30. The plating liquid in the plating bath 30 is exchanged at a fixed rate with the plating liquid in a plating liquid circulation bath 40 (f1: the flow from the plating bath 30 to the plating liquid circulation bath 40, f2: the flow from the plating liquid circulation bath 40 to the plating bath 30). By the application of the plating liquid regenerating method in the present embodiment, the plating liquid in the plating liquid circulation bath 40 is regenerated at a fixed frequency (or at an appropriate frequency). Accordingly, the plating liquid in the plating liquid circulation bath 40 proceeds to be regenerated gradually, and in accordance therewith, the plating liquid in the plating bath 30 proceed to be regenerated.

The plating liquid (plating waste liquid) in the plating liquid circulation bath 40 moves into a copper deposition bath 11 of a copper deposition dissolver 10 at a fixed amount rate (f3). The copper deposition bath 11 is also in communication with a copper dissolver 12 next thereto through an anion-exchange membrane 13 constituted by an anion exchanger. Electrolytic solution in an electrolyte bath 22 which is in communication with an iron deposition bath 21 referred to later through an anion-exchange membrane 23 is moved into the copper dissolver 12 (f6).

A cathode 15 is inserted into the plating waste liquid in the copper deposition bath 11. As the cathode 15, there is utilized an electrode that was inserted into the copper dissolver 12 in the operation preceding by one (i.e., one having been restored to the original configuration as a result of the dissolving of the copper adhered thereto) (FIG. 2(*a*)). As an anode 16 inserted into the copper dissolver 12, one being the same as the cathode 15 can be used at the very beginning as it is. It is desirable that those being the same are used as the cathode 15 and the anode 16 because of being exchanged in use. Then, at the second time or any subsequent time in the plating liquid regenerating method, one that was used as the cathode 15 at the operation (plating liquid regenerating method) preceding by one and that has the recovered copper deposited on the surface is used as the anode (FIG. 2(*d*)).

Very first Step: When electric current is applied from a direct-current power supply 14 to between the cathode 15 and the anode 16 in the state shown in FIG. 2(*a*), Cu proceeds to deposit on the cathode 15 as shown in FIG. 2(*b*), sulfate ions move into the electrolytic solution on the anode side through the anion-exchange membrane 13, and the electrolysis of water takes place on the anode 16 to generate oxygen gas. The electrification is continued until Cu ions in the plating waste liquid on the cathode side disappear (FIG. 2(*c*)). The plating waste liquid in the copper deposition bath 11 from which the Cu ions have disappeared is moved into the iron deposition bath 21 on a cathode 25 side of an iron removal bath 20. New plating waste liquid is supplied from the plating liquid circulation bath 40 into the emptied copper deposition bath 11 (FIG. 2(*d*)) and is subjected to the plating liquid regeneration.

Step at the second time or any subsequent time: Subsequently, when electric current is applied to between the cathode 15 and the anode 16 in the state shown in FIG. 2 (*d*), Cu proceeds to deposit on the cathode 15, while the copper adhered to the anode surface proceeds to dissolve from the anode 16 into the electrolytic solution, as shown in FIG. 2(*e*). Sulfate ions move into the electrolytic solution on the anode side through the anion-exchange membrane 13. The electrification is continued until the Cu ions in the plating waste liquid on the cathode side disappear or until the copper on the anode 16 disappears (FIG. 2(*f*)). The plating waste liquid in the copper deposition bath 11 from which the Cu ions have disappeared is moved into the iron deposition bath 21 on the cathode 25 side of the iron removal bath 20. New plating waste liquid is supplied from the plating liquid circulation bath 40 into the emptied copper deposition bath 11 (FIG. 2(*d*)) and is subjected to the plating liquid regeneration. After this, by repetitively performing the step that is for the second time or any subsequent time, the copper and the sulfate ions contained in the plating waste liquid can be recovered in a high purity, and the regeneration of the plating liquid can be carried out.

Step for removing iron: The cathode 25 is inserted into the iron deposition bath 21 in the iron removal bath 20, the anode 26 is inserted into the electrolyte bath 22 which is in communication with the iron deposition bath 21 through the anion-exchange membrane 23 (for which there may be used one that is the same as the anion-exchange membrane 13), and electric current is applied from a direct-current power supply 24, whereby Fe ions (together with Sn ions where the same are contained) deposit on the surface of the cathode 25. It may be the case that Sn ions constitute precipitations at the time of the aforementioned electrification in the copper deposition bath 11, and thus, by separating the precipitations when the waste liquid is moved from the copper deposition bath 11, it becomes possible to remove the Sn ions further reliably. The liquid in the electrolyte bath 22 and the liquid in the iron deposition bath 21 of the iron removal bath 20 after the removal of iron and stannum can be used to control the concentration of plating liquid or can be utilized as electrolytic solution to be put into the aforementioned copper dissolver 12 (f6, f7). Water is replenished into the iron deposition bath 21 and the electrolyte bath 22 because the amounts contained in the same are reduced due to evaporation during the deposition of iron (f8). Where consideration is taken for ease in separating the iron deposited, it is desirable that titan or stainless steel is chosen as the electrode on the cathode side.

Others

In the copper deposition bath 11, the copper dissolver 12 and the iron deposition bath 21, there can be provided stirring devices for stirring the liquids therein. By providing the stirring devices, it is possible to bring the copper or the like peeled off the electrodes again into contact with the electrodes, and hence, to make the desired reactions progress. Particularly, the stirring in the copper dissolver 12 brings the peeled-off copper again into contact with the anode 16 to make the dissolving of the copper progress.

(Plating Method and Plating Apparatus)

In a plating method in the present embodiment, a plating (copper plating or bronze plating) taking copper as chief constituent is carried out on the surface of a wire (corresponding to the aforementioned to-be-plated member) made of steel. The plating method in the present embodiment comprises a pretreatment step of easing the plating to proceed, a plating step of actually performing a plating, a finishing step of performing the removal of the plating liquid adhered to the surface of the wire, and a regenerating step of regenerating the plating waste liquid produced through the plating step. The aforementioned plating liquid regenerating method in the present embodiment is applicable to the regenerating step as it is. Further, the plating apparatus in the present embodiment is an apparatus that realizes these methods.

Pretreatment Step

The pretreatment step includes an electrolytic degreasing step. The pretreatment step is a step of pretreating the wire to make the same a pretreated wire that is easy to plate. The wire being easy to plate exposes steel as uncovered on the surface. The electrolytic degreasing step is a step of removing the dirt adhered to the surface of the wire by applying electric current to between the wire and degreasing liquid with the wire immersed in the degreasing liquid. Liquid that conducts electric current suffices as the degreasing liquid, and for example, there can be exemplified a water solution with, for example, some kind of electrolyte dissolved therein. As the electrolyte, there can be exemplified acid such as sulfuric acid, hydrochloric acid or the like, alkali such as sodium hydroxide, potassium hydroxide or the like, salt such as sodium chloride or the like. Particularly, it is desirable to use the sulfuric acid that is contained in the plating liquid. Where sulfuric acid is employed, no large problem does not arise even if the wire is immersed in the plating liquid as it is.

When electric current is applied to the wire taken as electrode, gasses (hydrogen and oxygen) are produced from the surface of the wire, and the surface is cleansed by a physical action that occurs together with the production of bubbles. Further, the melting of the wire surface itself results in cleansing the surface.

The pretreatment step may include an oxide film removal step prior to the electrolytic degreasing step. The oxide film removal step is a step of removing oxide films existing on the surface of the wire. No particular limitation is given to the method of removing the oxide films. Besides a method of mechanically removing the oxide films from the surface of the wire, there can be employed a method of performing a cleaning with an acid being higher in concentration than such an acid as used in the electrolytic degreasing step. As the mechanically removing method, there can be exemplified a method of emitting a jet of powder onto the surface of the wire (a method similar to a shot peening), a method of abrading the surface with powder particles such as abrasive grains, or the like. Where the oxide films are removed by the physical technique like this, ruggedness appears on the surface of the wire, so that the strength in adherence of plating increases.

In a specific method, the removal of the oxide films is carried out by the use of a surface treatment device that performs a surface treatment on the wire passing through the powder that is charged in an elastic tube to be able to be supplied to or discharged from the same. This surface treatment device has at least one surface treatment unit, and the unit is a device provided with the tube which has powder charged to be able to be supplied to or discharged from the tube and which allows the wire to movably pass through the powder, pressing means for cyclically pressing and releasing the tube, and feed means for moving the wire passing through the power. The wire goes through openings at the both ends of the tube. Alumina can be used as the powder.

Removed oxide films are accumulated in the powder, that is thus exchanged with fresh powder regularly. The powder recovered after use can regenerated by having accumulated oxide films and fragmented powder removed therefrom through sieving.

Plating Step

The plating step is a step of plating the pretreated wire by immersing the same in plating liquid (immersion plating) to make a plated wire. The plating liquid contains at least copper ions. As counter ions of copper ions, sulfate ions can be exemplified though a limitation is not given thereto in particular. Besides copper ions, it is possible for the plating liquid to contain stannous ions. Where stannous ions are contained, a bronze plating can be carried out. No limitation is given particularly to the concentration of copper ions or the like. Since the concentration of copper ions decreases as the plating is performed on the pretreated wire at the plating step, copper ions are replenished when the concentration is lowered to a fixed level or below. With the progress of the immersion plating, Fe ions in the plating liquid rises in concentration, and hence, when the concentration rises to a fixed level or higher, a part or all of the plating liquid is recovered and is processed at the regenerating step. At the regenerating step, the copper ions remaining are recovered, and if need be, Fe ions are also removed. Where iron ions are not removed at the regenerating step, it is possible to remove the iron ions at the electrolytic degreasing step referred to later. Copper ions that have fallen in short can be replenished by the addition of copper sulfate or the like.

Finishing Step

The finishing step comprises a washing step and a drying step. The washing step is a step of washing the plated wire by immersing the same in cleaning liquid to remove the plating liquid adhered to the surface. The washing effect is improved by making the cleaning liquid flow in a direction opposite to the movement of the plated wire. The cleaning liquid takes water as chief constituent. The drying step is a step of dying and removing the cleaning liquid adhered to the surface of the plated wire. As the drying and removing method, there can be exemplified a method of evaporating the clearing liquid by heating the wire at a high temperature, a method of exposing the wire to a blow to blow the cleaning liquid away, a method being in combination of the both methods, or the like.

About Balance of Water

The liquid processed and remaining at the regenerating step is added to the degreasing liquid at the electrolytic degreasing step. The copper ion-containing solution at the regenerating step is added to the plating liquid at the plating step. A situation is considered wherein the copper ion-containing solution by itself does not satisfy required concentrations in copper ion and sulfate ion (also in stannous ion in the case of a bronze plating). In such a situation, the concentrations are can be controlled by the addition of sulfate containing copper and stannum. Further, the copper ion-containing solution can be diluted by the addition of water thereto if, in a rare possibility, containing copper ions and stannous ions that are higher in concentration than as required.

The degreasing liquid at the electrolytic degreasing step is reduced in the Fe ion concentration at an iron removal step of removing Fe ions contained in the degreasing liquid. At the iron removal step, Fe ions are precipitated and removed by being oxidized to trivalence to raise the pH. The oxidization method can be done by the exposure to oxygen (air) or ozone or by the addition of hydrogen peroxide water. The removal of iron does not require, as essential, being done until the concentration completely becomes zero, and suffices to have the concentration lowered to a certain level. The iron removal step may be done together with "the iron removal step" that is done at the regenerating step.

In explanation of the water flow in the plating method in the present embodiment, water being low in the concentration of copper ions or the like is required as cleaning liquid used in the washing step, and thus, water replenished from outside is used. Because of containing electrolyte only a little, the water after washing the plated wire can be utilized as it is for the electrolytic solution on the anode side at the regenerating step. At this place, the copper deposited on the anode dissolves, and the sulfate ions contained in the plating waste liquid existing at the cathode comes thereto, whereby the water turns into copper ion-containing solution containing copper sulfate and is put in the plating liquid as it is or after the addition of copper sulfate. With the progress of the plating step, the plating liquid decreases in the concentration of copper ions (stannous ions where the same are contained) and increases in the concentration of iron ions because of the dissolving from the wire. When the concentration of the copper ions decreases to a fixed level or below or when the concentration of the iron ions increases to a fixed level or higher, a part or all of the plating liquid is taken out as plating waste liquid before the progress of the plating is affected. The plating waste liquid is put in the cathode side at the regenerating step, where the dissolving copper ions are recovered, and the sulfate ions contained therein move toward the anode side, so that the plating waste liquid decreases in the concentrations of the copper ions and the sulfate ions. Thereafter, the iron is removed at the step of removing iron, and the processed remaining liquid whose ion concentration has become a fixed level or lower is put in the degreasing liquid at the electrolytic degreasing step. At the electrolytic degreasing step, the water contained decreases by being decomposed through the electrolysis or by the evaporation occurring together with the electrolysis. In this case, by controlling a train of water flows to become a fixed amount, the water added at the washing step is moved to the successive steps one after another and finally decreases through the evaporation or the like at the electrolytic degreasing step. Therefore, the production of the waste liquid that has to be disposed for the outside does not take place. Further, at the electrolytic degreasing step, because the concentration of iron ions increases gradually, the removal of the iron ions (iron removal step) is carried out properly (continuously or intermittently). The iron is removed as solid matter.

IMPLEMENTED EXAMPLES

Experiment 1

Review of Material for Electrodes

The plating liquid regenerating method was carried out in combinations between a cathode and an anode (cathode: −, anode: +) shown in Table 1, and the material for the electrodes was reviewed. As the plating waste liquid and the electrolytic solution used, the plating waste liquid being 5.2 g/l in copper concentration and 21.4 g/l in iron concentration was used in the amount of 2 liters and electric current was applied.

In the copper dissolver, there was used a solution that 75% sulfuric acid in the amount of 30 ml was dissolved in water in the amount of 2 liters. As the anion-exchange membrane that is in communication with the copper deposition bath and the copper dissolver, there was used SELEMION® AAV in trade name (manufactured by AGC ENGINEERING CO., LTD.) having a weakly basic functional group. The results are shown in Table 1.

In Table 1, set values of voltage/current mean that each of both values is taken as upper limit to which adjustment is made to come close. For example, where the setting is made as 35 V at 2 A, the voltage, when attaining 35 V, will not be raised even if the current value has not reached 2 A, or when the current attains 2 A, the voltage will not be raised further (the same is true hereafter). Further, in Table 1, $IrO_2$(Ti) indicates titan with iridium oxide plated thereon.

TABLE 1

| | Electrode Material | | Set values of Voltage/current 35 V, 2 A | 35 V, 5 A | 35 V, 10 A | 35 V, 20 A | Anode dissolve | Cathode acidproof | Cost | Judgment |
|---|---|---|---|---|---|---|---|---|---|---|
| Exp. Ex. 1 | −: $IrO_2$(Ti) | Voltage (V) | 8.0 | 17.8 | 33.9 | 35.1 | Little | High | High | Good |

TABLE 1-continued

| | Electrode Material | | Set values of Voltage/current 35 V, 2 A | 35 V, 5 A | 35 V, 10 A | 35 V, 20 A | Anode dissolve | Cathode acidproof | Cost | Judgment |
|---|---|---|---|---|---|---|---|---|---|---|
| | +: $IrO_2$(Ti) | Current (A) | 2 | 5.0 | 10.0 | 10.8 | | | | |
| Exp. Ex. 2 | −: Ti | Voltage (V) | 7.9 | 18.0 | 33.1 | 35.1 | Little | High | High | Good |
| | +: $IrO_2$(Ti) | Current (A) | 2 | 5.0 | 10.0 | 10.6 | | | | |
| Exp. Ex. 3 | −: Ti | Voltage (V) | 15.9 35.1 | — | — | — | Little | High | low | Unfavorable |
| | +: Ti | Current (A) | 2.0 0.5 or lower | — | — | — | | | | |
| Exp. Ex. 4 | −: SUS | Voltage (V) | 7.4 | 17.2 | 32.5 | 35.1 | Much | High | Low | Unfavorable |
| | +: Cu | Current (A) | 2.0 | 5.0 | 10.0 | 10.8 | | | | |
| Exp. Ex. 5 | −: SUS | Voltage (V) | 8.8 | 18.7 | 33.8 | 35.1 | Much | High | Low | Unfavorable |
| | +: SUS | Current (A) | 2.0 | 5.0 | 10.0 | 10.5 | | | | |

As clear from Table 1, it was grasped that in other experiment examples (experiment examples 1, 2, 4 and 5) than experiment example 3 using titan for the anode, electric current flowed until copper deposited completely. In the experiment example 3, it is deemed that electric current flowing became a little because conductivity was low in the passive state occurring as a result that the surface of titan constituting the anode was oxidized.

Then, in terms of the durability of the anode, a high durability was demonstrated in the experiment examples 1 and 2 employing titan plated with iridium oxide, whereas it was difficult to say that sufficient durability was demonstrated in other experiment examples. Where the anode employs copper (experiment example 4) or stainless steel (experiment example 5), the dissolving of the anode into the electrolytic solution was observed. Copper, where employed as anode, dissolves into the electrolytic solution, and this is advantageous because of being utilized for the replenishment of copper into the plating liquid.

In the review of the acid resistivity of the cathode, it was grasped that sufficient acid resistivity was demonstrated in all of the experiment examples 1, 2, 3, 4 and 5.

In the comprehensive judgment based on the foregoing results, it was grasped that respective combinations of the experiment examples 1 and 2 were superior though being high in cost. It is deemed that the high cost is permissible thanks to the high durability.

As the cathode-side electrode at the time of iron deposition, titan, stainless steel or the like consisting of or containing a less nobler metal than iron is desirable in order to ease the deposition of iron, whereas as the anode-side electrode, Pt(Ti), Ir(Ti) or $IrO_2$(Ti) comes up in order to avoid the dissolving. In consideration of easiness in peeling off the iron deposited on the cathode as well as both aspects in price and performance, it was grasped that choosing a stainless steel electrode as the cathode and $IrO_2$(Ti) as the anode was desirable.

Experiment 2

Regeneration of Copper Plating Waste Liquid

First Time Regeneration

By the use of titan electrodes plated with iridium oxide for both of the cathode and the anode, electric current was applied for 28 hours to the plating waste liquid (100 liters) being 5.6 g/l in copper concentration and 12.6 g/l in iron concentration on the cathode side and to the electrolytic solution being 0.0 g/l in copper concentration and 0.0 g/l in iron concentration on the anode side. The condition for the electrification was set to 60V at 20 A. As a result, 14.7V at 20 A at the starting of electrification turned to 9.4 V at 20 A at the termination of electrification. After the termination of electrification, the copper concentration became 0.5 g/l and the iron concentration became 12.9 g/l. The pH on the cathode side was 1.5 before the electrification and 2.0 after the electrification, and that on the anode side was 1.2 before the electrification and 1.2 also after the electrification.

Regenerating Step at Second Time (Wherein the Preceding Cathode (with Copper Deposited Thereon) was Used as it was for the Anode)

The used waste liquid on the cathode side after the completion of the regeneration at the first time was moved to the cathode bath at the iron deposition step, and new waste liquid in the amount of 100 liters was put in the emptied bath. By the use of the titan electrodes plated with iridium oxide for both of the cathode and the anode, electric current was applied for 28 hours to the plating waste liquid being 5.6 g/l in copper concentration and 11.9 g/l in iron concentration on the cathode side and to the electrolytic solution being 0.0 g/l in copper concentration and 0.0 g/l in iron concentration on the anode side. The cathode at the preceding time (one with copper deposited on the surface) was used for the anode side.

The condition for the electrification was set to 60 V at 20 A. As a result, 12.1 V at 20 A at the starting of electrification turned to 2.5 V at 20 A at the termination of electrification. After the termination of electrification, the waste liquid on the cathode side became 0.6 g/l in copper concentration and 12.1 g/l in iron concentration. The electrolytic solution at the anode became 3.0 g/l in copper concentration and 0.1 g/l in iron concentration. The pH on the cathode side was 1.3 before the electrification and 1.8 after the electrification, and that on the anode side was 1.0 before the electrification and 1.1 after the electrification.

The range of pH when copper deposits and dissolves is good to be 0.75-2.0. It is difficult to keep less than 0.75 by the use of chemicals, and being 2.0 or over results in an increase of power consumption. Favorably, the pH is good to be in a range of 1.0-1.5.

Iron Deposition Step

In the regeneration of the copper plating waste liquid, the used waste liquid on the cathode side was moved to the cathode side bath at the iron deposition step. By the use of a stainless steel electrode for the cathode and a titan electrode plated with iridium oxide for the anode, electric current was applied for 60 hours to the plating waste liquid (22 liters) being 0.6 g/l in copper concentration and 11.9 g/l in iron concentration and to the electrolytic solution being 0.0 g/l in copper concentration and 0.0 g/l in iron concentration on the anode side.

In order to perform iron deposition smoothly, the pH at the cathode is controlled to come in a range of 2.0 or over to less than 3.0 by the addition of pH control chemicals. By controlling the pH to be 2.0 or higher, it becomes possible to immediately begin the deposition of iron, so that electric power consumed until iron deposits can be saved. By controlling the pH to be less than 3.0, it becomes possible to ease the deposition of iron. Where the pH becomes 3 or higher, iron constitutes iron hydroxide which is hard to deposit. As the pH control chemicals, it is desirable to employ one which does not affect the recycling of the liquid, and particularly, there can be utilized hydrogen peroxide, ozone or the like consisting of oxygen and hydrogen. Although the rise of the pH could be expected by the addition of oxygen, the present experiment revealed that adding hydrogen peroxide or ozone, rather than adding oxygen, effectively contributed to the final deposition of iron.

The condition for the electrification was set to 60 V at 10 A. As a result, the electrified actual voltage and actual current respectively became 28.6 V and 10 A at the termination of electrification. After the termination of electrification, the waste liquid on the cathode side turned to 0.0 g/l in copper concentration and 2.0 g/l in iron concentration, whereas the electrolytic solution at the anode did not have any change in the copper concentration remaining as 0.0 g/l and the iron concentration remaining as 0.0 g/l. The pH on the cathode side was 2.0 before the electrification and 2.1 after the electrification, and that on the anode side was 1.0 before the electrification and 0.8 after the electrification.

Experiment 3

Regeneration of Bronze Plating Waste Liquid

First Regeneration

By the use of titan electrodes plated with iridium oxide for both of the cathode and the anode, electric current was applied for 28 hours to the plating waste liquid (100 liters) being 5.5 g/l in copper concentration, 12.8 g/l in iron concentration and 0.2 g/l in stannum concentration. The condition for the electrification was set to 60V at 20 A. As a result, 14.7 V at 20 A at the starting of electrification turned to 9.4 V at 20 A at the termination of electrification. After the termination of electrification, the copper concentration became 0.5 g/l, the iron concentration became 13.0 g/l and the stannum concentration became 0.0 g/l. The pH on the cathode side was 0.8 before the electrification and 1.0 after the electrification, and that on the anode side was 1.0 before the electrification and 0.9 after the electrification.

Regenerating Step at Second Time (Wherein the Cathode at the Preceding Time was Used as it was for the Anode)

As the plating waste liquid on the cathode side, the same liquid as used for the first regeneration was newly put and used. The electrolytic solution on the anode side was utilized as it was. The electrolytic solution on the anode side was 0.0 g/l in copper concentration, 0.0 g/l in iron concentration and 0.0 g/l in stannum concentration (100 liters). Electric current was applied for 28 hours with the electrodes for the cathode and the anode exchanged with each other.

The condition for the electrification was set to 60 V at 20 A. As a result, 12.1 Vat 20 A at the starting of electrification turned to 2.5 V at 20 A at the termination of electrification. After the termination of electrification, the waste liquid on the cathode side became 1.0 g/l in copper concentration, 12.9 g/l in iron concentration and 0.0 g/l in stannum concentration, whereas the electrolytic solution at the anode became 2.9 g/l in copper concentration, 0.1 g/l in iron concentration and 0.0 g/l in stannum concentration. The pH on the cathode side was 0.8 before the electrification and 1.1 after the electrification, and that on the anode side was 0.8 before the electrification and 0.9 after the electrification.

Iron Deposition Step

By the use of a stainless steel electrode for the cathode and an iridium oxide electrode for the anode, electric current was applied for 60 hours from the beginning of the iron deposition to the plating waste liquid (22.0 liters) being 0.7 g/l in copper concentration, 12.3 g/l in iron concentration and 0.0 g/l in stannum concentration in the waste liquid on the cathode side and to the electrolytic solution (22.0 liters) being 0.0 g/l in copper concentration, 0.0 g/l in iron concentration and 0.0 g/l in stannum concentration on the anode side.

The condition for the electrification was set to 60 V at 10 A. As a result, 32.3 V at 10 A at the starting of electrification turned to 60 V at 8.7 A at the termination of electrification. After the termination of electrification, the waste liquid on the cathode side became 0.0 g/l in copper concentration, 2.4 g/l in iron concentration and 0.0 g/l in stannum concentration, whereas the electrolytic solution at the anode did not have any change in the copper concentration remaining as 0.0 g/l, the iron concentration remaining as 0.0 g/l and the stannum concentration remaining as 0.0 g/l. The pH on the cathode side (waste liquid side) was 1.9 before the electrification and 2.1 after the electrification, and that on the anode side was 1.1 before the electrification and 0.6 after the electrification.

Results

As clear from the experiments 2 and 3, the copper and the iron contained in the plating waste liquid were able to be recovered at a high yield. Further, regarding copper, it was grasped that it was possible to dissolve the recovered copper in the liquid as need arises and to regenerate the copper plating liquid. Regarding stannum, it was grasped that the separation could be done as precipitations through a temperature change made by electrification without waiting for the deposition by the electrification. The bronze plating liquid can be regenerated by dissolving stannous sulphate in the regenerated copper plating liquid.

Experiment 4

About Balance (Circulation) of Water in Plating Method

Shown hereinafter are results of an experiment that was carried out for the flow of water as well as for ion concentration in the mid course of the flow. In the present experiment, the wire was processed in the order of the pretreatment step (the oxide film removal step and the electrolytic degreasing step), the plating step and the finishing step (the washing step and the drying step). The oxide film removal step was carried out by using the foregoing surface treatment device.

At the electrolytic degreasing step, the processed remaining liquid discharged from the regenerating step in the preceding cycle was used as degreasing liquid. The degreasing liquid at the electrolytic degreasing step was circulated in part to the iron removing device for carrying out the iron removal step and was processed to remove iron therefrom continuously. At the electrolytic degreasing step, water was reduced at the rate of 65 liters per predetermined unit time due to evaporation or the like. As the plating liquid, the copper ion-containing solution regenerated at the regenerating step was used after having the ion concentration controlled by the addition of copper sulfate or the like. The plating waste liquid produced at the plating step was moved to the regenerating step after having stannum removed therefrom. The waste liquid was moved to the regenerating step at the rate of 80 liters per unit time. The waste liquid was further decreased on the cathode side at the regenerating step and was moved to the electrolytic degreasing step at the velocity of 65 liters per unit time. As the clearing liquid at the washing step, city water was utilized as it was. City water was used at the rate of 80 liters per unit time, was moved as it was to the anode side at the regenerating step, and was transferred as it was at the velocity of 80 liters per unit time to be used as plating liquid at the next cycle. Table 2 shows the concentrations of major ions where this cycle was repeated three times. In Table 2, "next step" means what step the liquid is transferred to after the present step. It may be the case that before being transferred to the next step, the liquid is subjected to some processing (for example, when transferred from 1-4 to 2-1, the liquid is subjected to a step of removing Fe ions). Further, regarding the step at third time, there is described a step at fourth time (listed as "4-3". "4-3" means the transfer to the plating liquid at fourth time) not listed in the table.

As clear from Table 2, it was grasped that respective ion concentrations increased and decreased similarly in general and were continuously sustainable. Replenished from outside in repeating this cycle were the water used at the washing step and copper ions and stannous ions corresponding to those decreased from the plating liquid. Then, discharged outside were water in gaseous form and iron in solid-state that were produced in the electrolytic degreasing step.

In short, the production of waste liquid or the like which should be disposed was not recognized.

INDUSTRIAL APPLICABILITY

By taking the foregoing constructions, the present invention is able to provide a method for regenerating plaiting liquid from plating waste liquid in a simple and easy way.

Further, by utilizing the aforementioned plating liquid regenerating method, the present invention is able to provide a plating method and a plating apparatus capable of reducing the amount of plating waste liquid.

The invention claimed is:

1. A method for plating a steel wire with plating liquid containing Cu ions, the method comprising:

performing electrolytic degreasing on the surface of the wire by applying electric current with the wire immersed in degreasing liquid, to obtain a pretreated wire;

plating the pretreated wire by immersing the wire in a plating liquid comprising Cu ions to obtain a plated wire;

washing the surface of the plated wire by immersing the plated wire in cleaning liquid comprising water as a major constituent; and drying the washed wire;

wherein the plating liquid is regenerated by a method comprising (i), (ii), (iii) and (iv):

TABLE 2

| | | First Time | | | | | Second Time | | | | |
|---|---|---|---|---|---|---|---|---|---|---|---|
| | | Washing Step 1-1 | Regenerating Step (Anode) 1-2 | Plating Liquid 1-3 | Regenerating Step (Cathode) 1-4 | Electrolytic Degreasing Step 1-5 | Washing Step 2-1 | Regenerating step (Anode) 2-2 | Plating Liquid 2-3 | Regenerating Step (Cathode) 2-4 | Electrolytic Degreasing Step 2-5 |
| Amount (l) | | 80 | 80 | 80 | 65 | 65 | 80 | 80 | 80 | 65 | 65 |
| Starting | Sn (g/l) | 0.00 | 0.00 | 0.50 | 0.00 | 0.00 | 0.00 | 0.00 | 0.41 | 0.01 | 0.00 |
| | Cu (g/l) | 0.00 | 0.17 | 5.65 | 5.83 | 0.00 | 0.00 | 0.16 | 6.13 | 5.60 | 0.03 |
| | Fe (g/l) | 0.00 | 0.45 | 0.48 | 8.53 | 0.26 | 0.00 | 0.80 | 0.61 | 9.04 | 3.11 |
| Terminatio | Sn (g/l) | 0.00 | 0.00 | 0.64 | 0.00 | 0.00 | 0.00 | 0.00 | 0.67 | 0.00 | 0.00 |
| | Cu (g/l) | 0.00 | 4.85 | 5.78 | 0.00 | 0.01 | 0.00 | 5.21 | 5.87 | 0.01 | 0.01 |
| | Fe (g/l) | 0.41 | 0.49 | 8.71 | 9.27 | 2.98 | 0.49 | 0.83 | 9.66 | 9.28 | 4.37 |
| Next Step | | 1-2 | 2-3 | 1-4 | 1-5 | — | 2-2 | 3-3 | 2-4 | 2-5 | — |

| | | Third Time | | | | |
|---|---|---|---|---|---|---|
| | | Washing Step 3-1 | Regenerating Step (Anode) 3-2 | Plating Liquid 3-3 | Regenerating Step (Cathode) 3-4 | Electrolytic Degreasing Step 3-5 |
| Amount (l) | | 80 | 80 | 80 | 65 | 65 |
| Starting | Sn (g/l) | 0.00 | 0.00 | 0.42 | 0.00 | 0.00 |
| | Cu (g/l) | 0.00 | 0.22 | 6.21 | 7.03 | 0.02 |
| | Fe (g/l) | 0.00 | 0.78 | 0.94 | 9.13 | 4.39 |
| Terminatio | Sn (g/l) | 0.00 | 0.00 | 6.13 | 0.00 | 0.00 |
| | Cu (g/l) | 0.01 | 6.32 | 0.52 | 0.01 | 0.00 |
| | Fe (g/l) | 0.44 | 0.99 | 9.12 | 9.22 | 4.33 |
| Next Step | | 3-2 | 4-3 | 3-4 | 3-5 | — |

(i) applying electric current between a plating waste liquid side taken as a cathode and an electrolytic solution side taken as an anode, such that the plating waste liquid and the electrolytic solution are connected through an anion exchanger, wherein the plating waste liquid comprises Fe ions and Cu ions;

(ii) separating copper from the plating waste liquid by making a copper deposition electrode as a result of depositing copper on an electrode in contact with the plating waste liquid, to convert the plating waste liquid to a processed remaining liquid, wherein an anode in contact with the electrolytic solution is a copper deposition electrode formed previously;

(iii) dissolving copper in the electrolytic solution to generate a copper ion-containing solution; and (iv) repeating (i), (ii) and (iii) one or more times;

wherein the regeneration is performed while plating waste liquid produced from the plating liquid during the plating is made to contact the cathode, and waste liquid from the washing is made to contact the anode;

the processed remaining liquid is added to the degreasing liquid for the degreasing, and the copper ion-containing solution is added to the plating liquid for the plating;

Fe ions are removed from the degreasing liquid, to reduce an Fe ion concentration; and an amount of water added to the cleaning liquid during the washing is approximately equal to an amount of water vaporizing during the electrolytic degreasing.

2. The method of claim 1, wherein the plating waste liquid further comprises stannous ions.

3. The method of claim 1, further comprising:

removing iron from the processed remaining liquid by depositing a substance containing iron by taking the processed remaining liquid as a cathode side and new electrolytic solution, connected to the processed remaining liquid through an anion exchanger, as an anode side and then by applying electric current;

wherein a solution comprising water is present on the anode side as an electrolytic solution after the iron has been removed from the processed remaining liquid.

4. The method of 3, further comprising, before the iron is removed from the processed remaining liquid, raising a pH by adding an oxygen-containing chemical compound comprising $H_2O_2$, $O_3$ or $H_2O$.

5. The method of claim 1, wherein the applied electric current is of an amount that corresponds to the greater of (a) a current amount corresponding to the amount of copper ions contained in the plating waste liquid and (b) a current amount corresponding to the amount of copper adhered to the copper deposition electrode.

6. The method of claim 1, further comprising:

removing iron from the processed remaining liquid by depositing a substance containing iron by taking the processed remaining liquid as a cathode side and new electrolytic solution, connected to the processed remaining liquid through an anion exchanger, as an anode side and then by applying electric current;

wherein a solution comprising water is present on the cathode side as an electrolytic solution after the iron has been removed from the processed remaining liquid.

7. The method of claim 1, further comprising, before the electrolytic degreasing, removing an oxide film from the surface of the wire;

wherein:

the removal of the oxide film is performed by a surface treatment device for a long wirelike article that performs a surface treatment on the long wirelike article movably passing through powder which is charged in an elastic tube to be supplied to, or discharged from, the tube; and the surface treatment device comprises a surface treatment unit, the surface treatment unit comprising:

the tube charged with the powder which can be supplied to or discharged from the tube, and having the long wirelike article movably passing through the powder;

a pressing device adapted to cyclically pressing and releasing the tube; and a feed device adapted to moving the long wirelike article passing through the powder.

* * * * *